US007966857B1

(12) United States Patent
Myers

(10) Patent No.: US 7,966,857 B1
(45) Date of Patent: Jun. 28, 2011

(54) METHOD OF MAKING AN HVAC HIGH EFFICIENCY TAKEOFF CONNECTOR

(75) Inventor: James R. Myers, Anoka, MN (US)

(73) Assignee: Sheet Metal Connectors, Inc., Minneapolis, MN (US)

( * ) Notice: Subject to any disclaimer, the term of this patent is extended or adjusted under 35 U.S.C. 154(b) by 769 days.

(21) Appl. No.: 11/968,471

(22) Filed: Jan. 2, 2008

Related U.S. Application Data

(60) Provisional application No. 60/878,581, filed on Jan. 4, 2007.

(51) Int. Cl.
*B21D 22/20* (2006.01)
*B21D 51/16* (2006.01)

(52) U.S. Cl. ..... 72/348; 29/890.141

(58) Field of Classification Search ..... 29/890.14, 29/890.141, 890.145, 890.148; 72/347–351, 72/379.2

See application file for complete search history.

(56) References Cited

U.S. PATENT DOCUMENTS

| | | | | |
|---|---|---|---|---|
| D059,194 | S | 10/1921 | Collins | |
| 1,413,492 | A | 4/1922 | Rees | |
| 1,493,224 | A | 5/1924 | Alston, Jr. | |
| 1,608,180 | A | 11/1926 | Nathanson et al. | |
| 1,717,443 | A | 6/1929 | Flood | |
| 1,771,176 | A | 7/1930 | Holub | |
| 1,918,715 | A * | 7/1933 | Robinson | 29/890.148 |
| 2,297,625 | A * | 9/1942 | Kotcher | 72/347 |
| 2,299,025 | A | 10/1942 | McGinley | |
| D155,687 | S | 10/1949 | Curtis | |
| 2,507,859 | A | 5/1950 | Keller | |
| D173,874 | S | 1/1955 | Milwid | |
| 2,963,783 | A | 12/1960 | Field | |
| 3,462,864 | A | 8/1969 | Merser | |
| 3,524,246 | A | 8/1970 | Hudson et al. | |
| 4,048,737 | A | 9/1977 | McDermott | |
| D257,060 | S | 9/1980 | Mann | D23/163 |
| D345,992 | S | 4/1994 | Mohsen | |
| D407,434 | S | 3/1999 | Moor | |
| 5,933,954 | A | 8/1999 | Lucente | 29/890.14 |
| D414,252 | S | 9/1999 | Orr | |
| 6,176,013 | B1 | 1/2001 | Lucente | 29/890.14 |
| D450,113 | S | 11/2001 | Teskey | |
| D461,551 | S | 8/2002 | Teskey | |
| D468,417 | S | 1/2003 | Leutz et al. | |
| D471,752 | S | 3/2003 | Haboush | |
| D480,754 | S | 10/2003 | Berger | |
| D493,322 | S | 7/2004 | Juliano | |
| D518,856 | S | 4/2006 | Russell | |
| D528,646 | S | 9/2006 | Stout, Jr. | D23/393 |
| 2003/0233797 | A1 | 12/2003 | Anderson | 52/218 |
| 2006/0105700 | A1 | 5/2006 | Hadlock, Jr. | 454/270 |
| 2006/0199505 | A1 | 9/2006 | Fettkether | 454/232 |

OTHER PUBLICATIONS

High Efficiency Takeoffs (H.E.T.O), 1 page, Sheet Metal Connectors, Inc. (publicly available prior to Jun. 27, 2006). Sheet Metal Connectors, Inc., Specifications for "The E-Z Flange Spiral Pipe System", Mar. 2004, 24 pages.

* cited by examiner

*Primary Examiner* — Debra M Sullivan
(74) *Attorney, Agent, or Firm* — Westman, Champlin & Kelly, P.A.

(57) ABSTRACT

An HVAC connector is disclosed that includes a one-piece conduit. The conduit includes a generally planar, rectangular mounting flange that defines an air inlet into the conduit. A first body portion extends from the mounting flange and a second body portion extends from the first body portion to define a generally tubular takeoff neck having a round outlet that is disposed generally parallel to the mounting flange.

8 Claims, 25 Drawing Sheets

METHOD OF MAKING AN HVAC HIGH EFFICIENCY TAKEOFF CONNECTOR

CROSS-REFERENCE TO RELATED APPLICATION

The present application is based on and claims the benefit of U.S. provisional patent application Ser. No. 60/878,581 entitled HVAC HIGH EFFICIENCY TAKEOFF CONNECTOR filed Jan. 4, 2007, the content of which is hereby incorporated by reference in its entirety.

BACKGROUND

In HVAC (heating, ventilating and air conditioning) systems, air flow typically is formed by main lines or ducts leading to duct branches and further sub-branches for delivery of conditioned air throughout a structure. The ductwork in such a system typically steps down in size, and thus branch ducts are smaller in size than feeder or main ducts. In addition, it may be desired to divert air flow from a duct having a generally planer slide (such as a duct having a square or rectangular cross section) to a duct having a circular cross section.

One connector developed for such connection is referred to as a high efficiency takeoff (H.E.T.O., alternatively HETO). Such a connector is designed with a rectangular inlet opening and a flange assembly extending about that opening. A connector body extends from the rectangular inlet opening and assumes a cylindrical shape some distance from the rectangular opening, thereby defining a circular outlet. The circular outlet is offset downstream relative to the rectangular opening. Previously, such a high efficiency takeoff connector has been formed from multiple sheets of metal. For example, two connector halves may be connected by rivets or welding together along a seam along a leading side of the body and a seam along a trailing side of the body. Additional metal parts may be added to fully define the flange assembly about the inlet opening.

Any time a seam is introduced into an HVAC duct work system, there exists the possibility for leakage of conditioned air from the system through that seam. In addition, fabricating a connector from two or more components introduces increased inefficiencies in manufacturing, both in requiring additional die forming capability and also in requiring additional labor through formation and assembly requirements.

SUMMARY

In one aspect, the present disclosure is directed to an HVAC connector for connecting a round branch air duct to a generally planar surface of an air feeder duct. The HVAC connector comprises a one-piece conduit having a generally planar, rectangular mounting flange that defines an air inlet into the conduit. The conduit also has a first body portion defined by a leading end wall, two side walls and a trailing end wall, with each wall projecting from the mounting flange. The leading end wall has a different slope relative to the mounting flange than the trailing end wall. The conduit has a second body portion wherein outer ends of the walls combine to define a generally tubular takeoff neck having a round outlet that is disposed generally parallel to the mounting flange.

In another aspect, a method is disclosed of making an HVAC high efficiency takeoff connector from a single sheet of generally planar metal. The method comprises drawing the metal sheet to define a first body portion projecting from a generally planar mounting flange, wherein the first body portion extends from a generally rectangular air inlet having a generally bow-shaped leading edge and that is coplanar with the mounting flange to a circular panel that is spaced from and generally planar to the mounting flange. The first body portion is defined by a leading end wall, two side walls and a trailing wall with the circular panel at outer ends of the walls, and the leading end wall has a different slope relative to the mounting flange than the trailing end wall. The method includes removing metal extending across the circular panel to define a round air outlet that is generally perpendicular to the mounting flange and offset towards the trailing end wall. The method further includes drawing the outer ends of the walls of the first body portion to define a second body portion projecting further away from the mounting flange. The second body portion forms a generally tubular takeoff neck that is aligned generally perpendicular to the mounting flange. The method further includes trimming excess metal from about the mounting flange to define a generally rectangular outer edge of the mounting flange.

This summary is provided to introduce a selection of concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE FIGURES

The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

Figure 1:
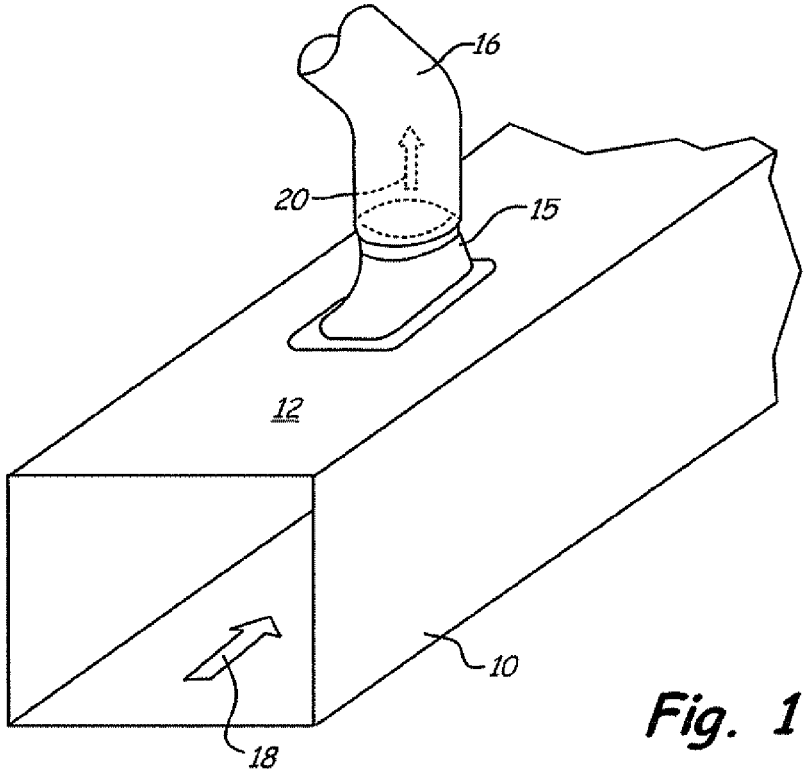
FIG. 1 is a schematic view of duct work HETO connector.

FIG. 1 schematically illustrates a duct work HETO connector. A first duct work 10 includes at least a first planar side 12. A HETO connector 15 is mounted to the planar side 12 to connect the first duct work 10 to a second round duct work 16.

The HETO is a seamless construction, formed from one piece of metal, with no seams thereon for forming the HETO itself or additional flange components thereof. As used herein, a seamless construction refers to a continuous structure that is not interrupted by seams, overlapping portions connected with fasteners and the like. The HETO connector 15 allows a diversion of airflow (flowing in direction of arrow 18 in duct 10) to a generally rectangular opening in the planar side 12 and into the connector 15, which directs the air into a circular outlet and into the round duct work 16 (in direction of airflow 20).

Figure 2A:
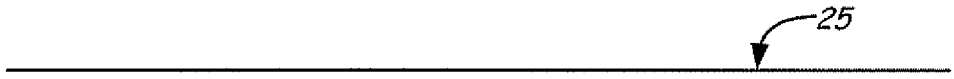
FIGS. 2A-2D are schematic views of steps in formation of a HETO connector.
Figure 2B:
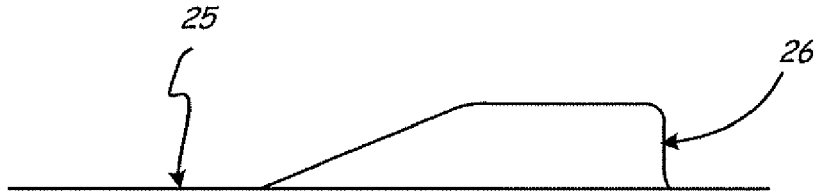
Figure 2C:
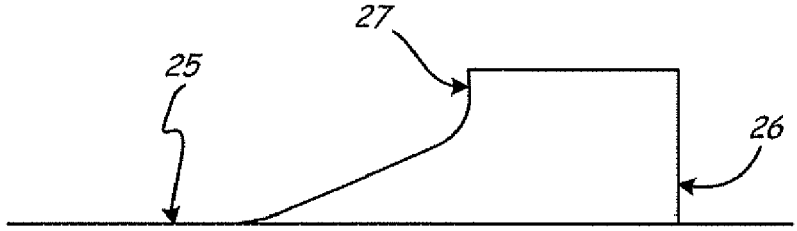
Figure 2D:
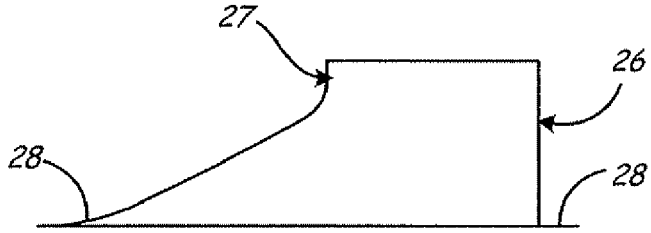

The one piece HETO connector 15 is formed from a single piece of sheet metal as explained below. FIG. 2 illustrates the basic steps in the formation of the HETO connector. A generally planar sheet of metal 25 is shown in FIG. 2A. The metal sheet is drawn by a die set to project a first body shape 26 therefrom as shown in FIG. 2B. A circular hole is punched from atop the first body shape and a cylindrical section 27 is then further formed (e.g., drawn) on the first body shape 26 and further projected from the remainder of the initial metal sheet 25, as shown in FIG. 2C. A trimming operation trims the metal sheet 25 to define a mounting flange 28 thereon, as shown in FIG. 2D. The first body shape 26, cylindrical section 27 and mounting flange 28 form a seamless construction.

Figure 3A:
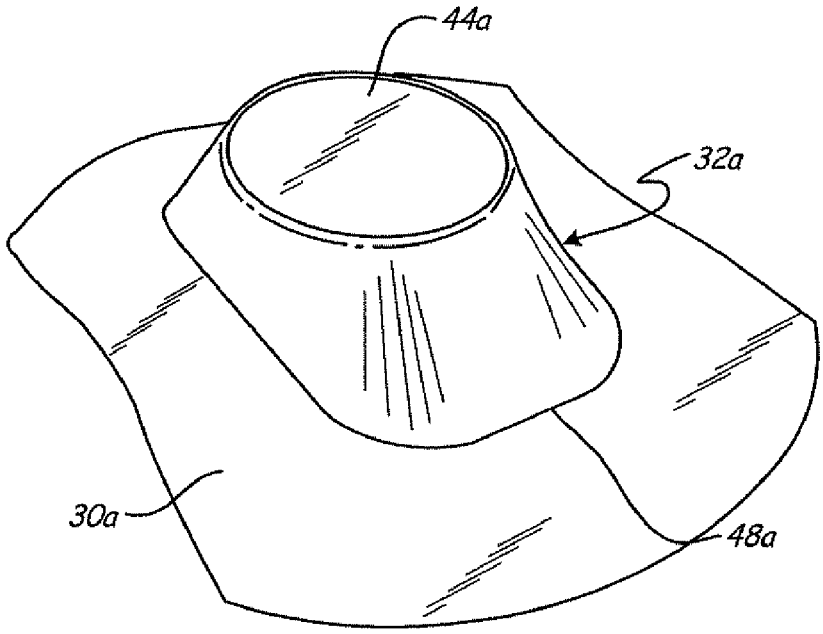
FIGS. 3A-3J are schematic views of an intermediate step in formation of a HETO connector.
Figure 3B:
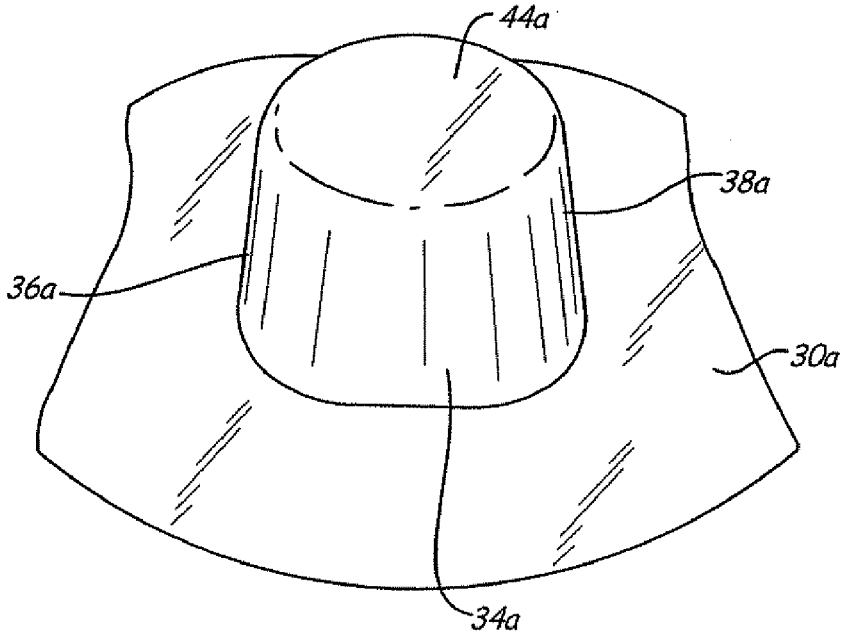
Figure 3C:
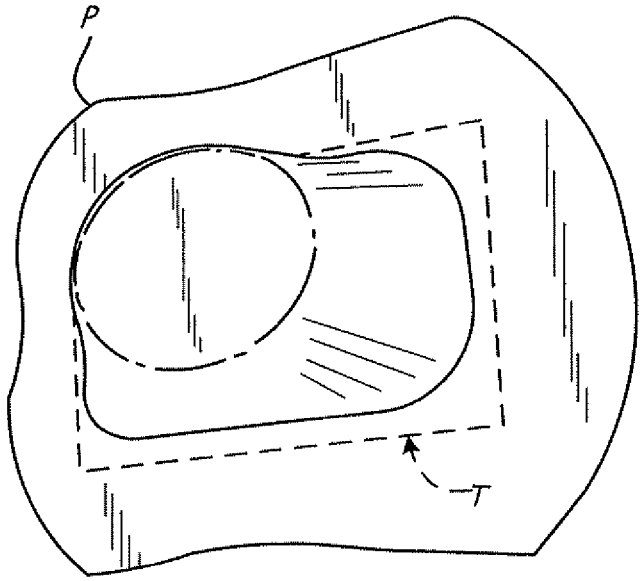
Figure 3D:
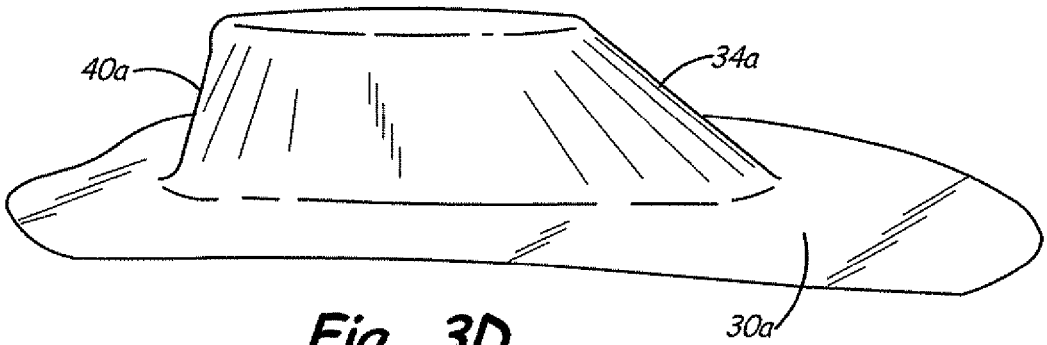
Figure 3E:
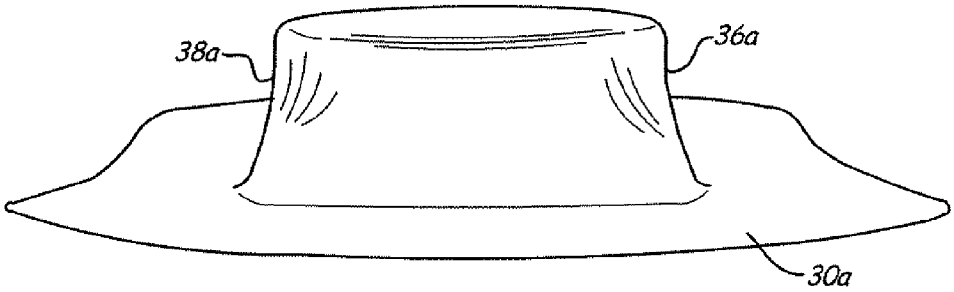
Figure 3F:
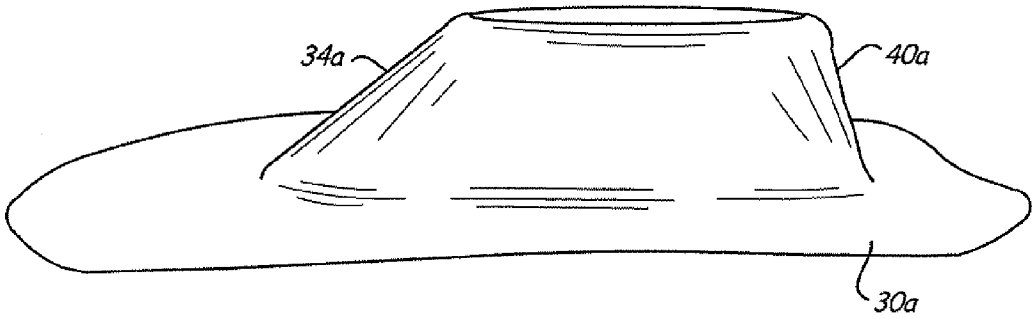
Figure 3G:
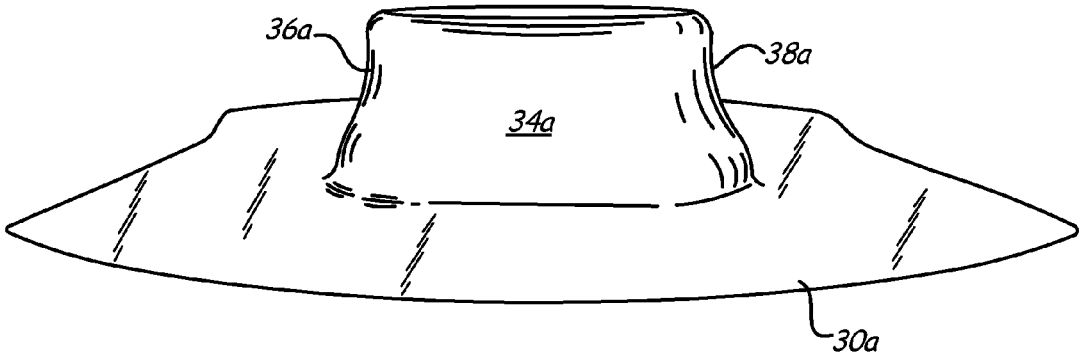
Figure 3H:
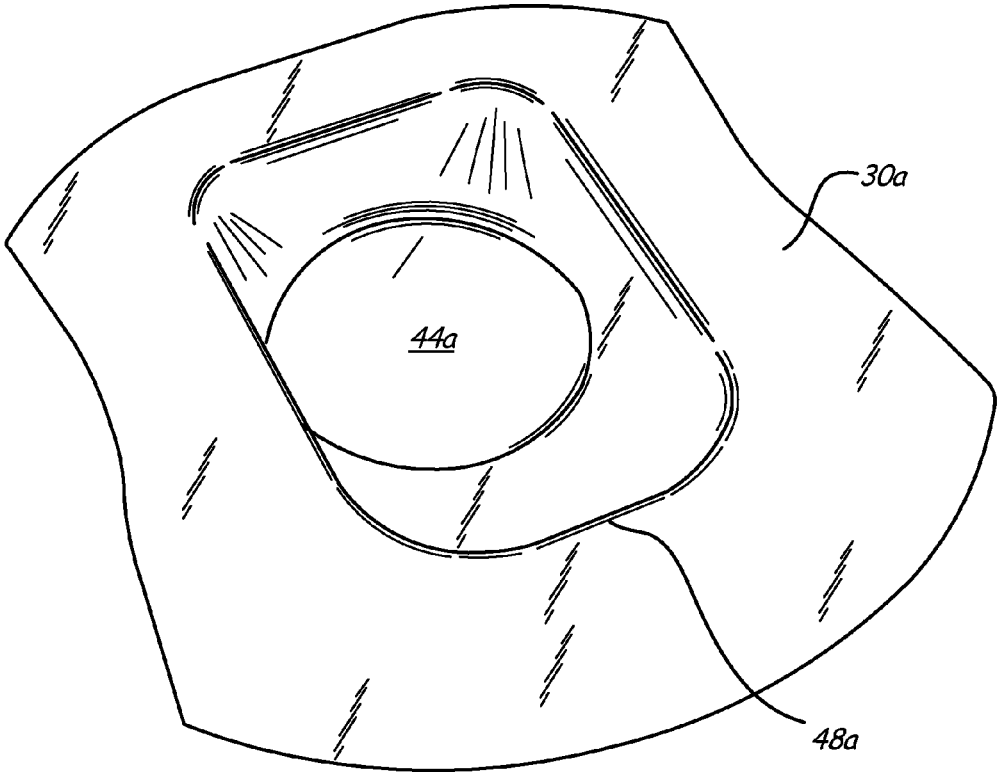
Figure 3I:
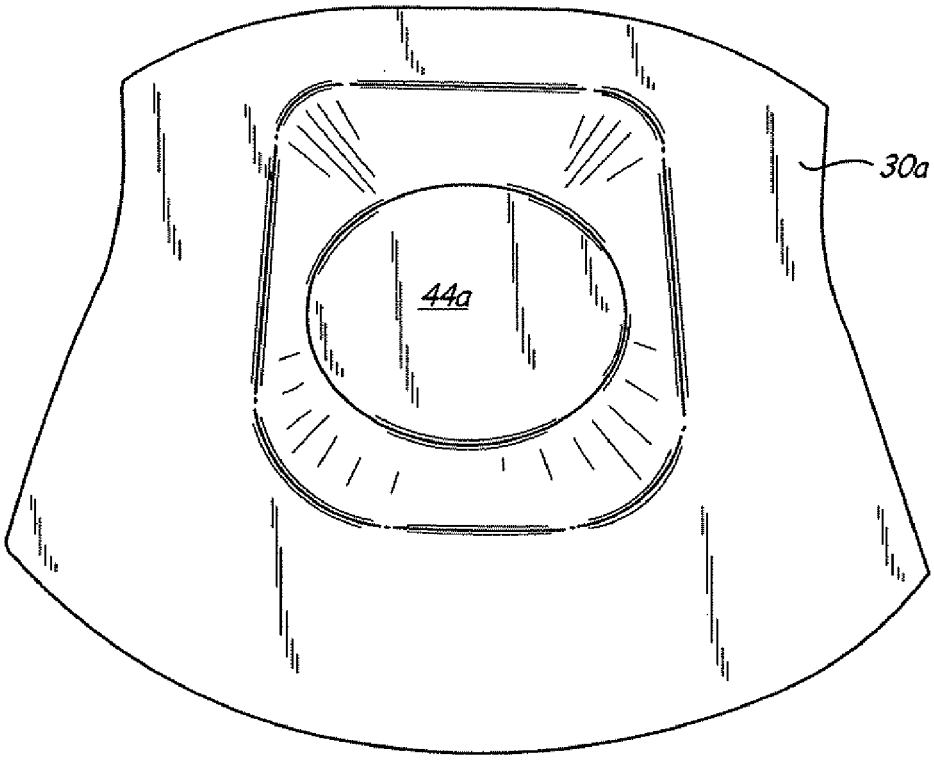
Figure 3J:
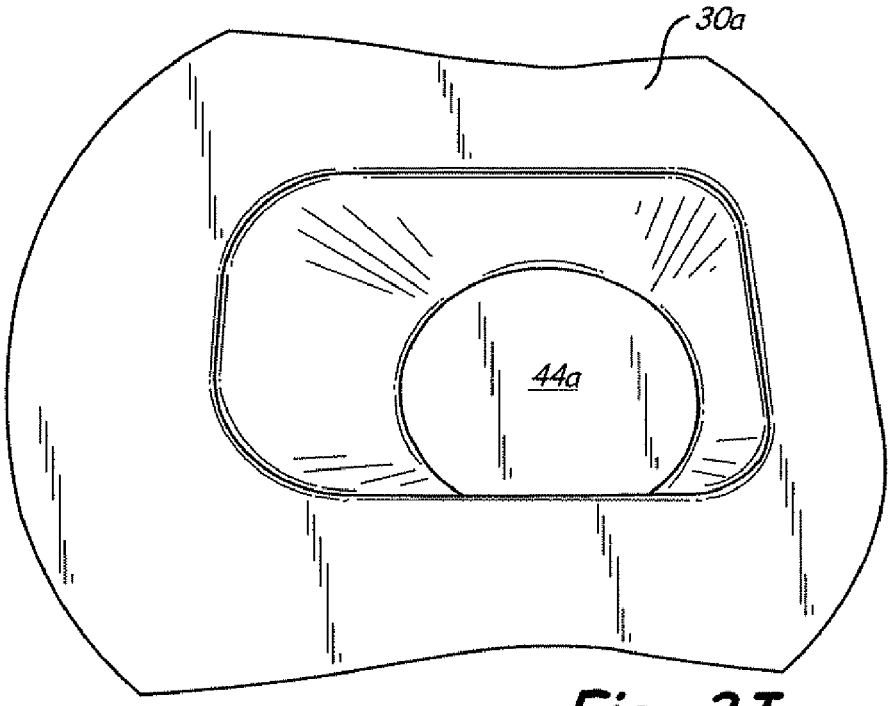
Figure 3K:
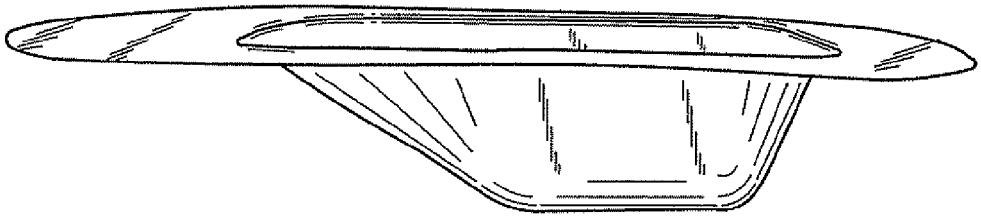

In one embodiment, the initial metal sheet is generally square or rectangular in shape. The illustrations of FIG. 3 show a HETO after the initial draw to form the first body portion shape thereon (an in-process unit). FIGS. 3A, 3B and 3C show top perspective views thereof. FIGS. 3D, 3E, 3F and 3G show generally side elevational views thereof. FIG. 3D shows an elevation from a first side, FIG. 3E shows an elevation from a rear or trailing side thereof, FIG. 3F shows an elevation from the other side thereof, and FIG. 3G shows a side elevation from a front or leading side thereof. FIGS. 3H, 3I and 3J illustrate bottom perspective views thereof. FIG. 3K is a side elevational view from one side thereof, with the bottom of the in-process unit on top as illustrated in FIGS. 3H, 3I and 3J. As seen in FIG. 3, the edges of the metal sheet are no longer linear. As the irregular shape of the first body portion is drawn from the metal sheet, the metal is drawn at different rates, thus forming an irregular edge pattern P (as seen in FIG. 3C).

The illustrations of FIG. 4 show a finished one piece and intregal HETO. The in-process unit of FIG. 3 has been further drawn to define a second cylindrical body portion extending from the first body portion and a circular outlet cut therein. In this final form, the one-piece HETO connector has a generally planar rectangular mounting flange that defines an air inlet into the connector. The first body portion is defined by a leading end wall, two side walls and a trailing end wall, with each wall projecting from the mounting flange. The leading end wall has a different slope relative to the mounting flange than the trailing end wall. The slope of the leading end wall is much shallower than the slope of the trailing end wall. The two side walls can have a similar slope to the trailing end wall. In addition, a distance along the leading end wall from the mounting flange to the second body portion can be at least two times greater than a distance along the trailing end wall from the mounting flange to the second body portion. The second body portion (body portion 42, as illustrated in FIG. 4) is defined by outer ends of the walls to define a generally tubular takeoff neck having a round air outlet. The air outlet is disposed generally parallel to the mounting flange.

Since the connector is formed from a single sheet of metal, there are no seams in the connector body or anywhere along the flange. Thus, the connector introduces no possible means for air to escape the duct work system via its integral construction. The connector also provides smooth and continuous airflow surfaces without seam projections or other internal projections, thereby enhancing the laminar nature of airflow therethrough (see FIGS. 4J to 4P). The air inlet is formed to be as large as possible and elongated for mounting along a planar surface of a feeding ductwork, while the air outlet is circular and is disposed at an orientation downstream from the initial edge of the air inlet. This orientation, along with the shallow slope of the leading wall, facilitates the flow of air from the main ductwork into the round branch ductwork connected to the tubular takeoff neck of the HETO connector.

In the embodiment illustrated in FIG. 4, a plurality of dimples are provided in the flange to locate mounting fasteners (i.e., sheet metal screws) for connecting the HETO connector to the main duct work. Alternatively, holes may be punched in the flange, or other suitable connector locator means provided. When assembled to a main duct 10, as illustrated in FIG. 1, a sealing gasket is also typically provided between the flange of the HETO connector 15 and the planar surface 12 of the duct 10.

FIGS. 4A, 4B, 4C, 4D and 4E illustrate perspective views of the HETO connector 15. The HETO connector 15 has a generally planar, rectangular mounting flange 30 and a first body portion 32 defined by a leading end wall 34, opposed side walls 36 and 38 and a trailing end wall 40. The second body portion 42 forms a generally tubular takeoff neck. Outer ends of the walls 34, 36, 38 and 40 define the second body portion 42. The tubular takeoff neck has a round air outlet 44. The air outlet 44 is disposed generally parallel to the mounting flange 30.

Figure 4A:
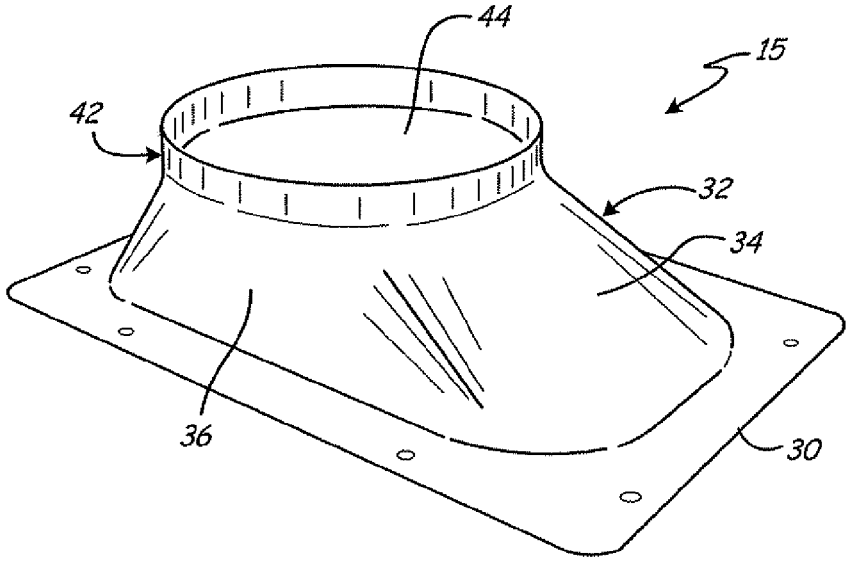
FIGS. 4A-4N and 4P are schematic views of a finished HETO connector.
Figure 4B:
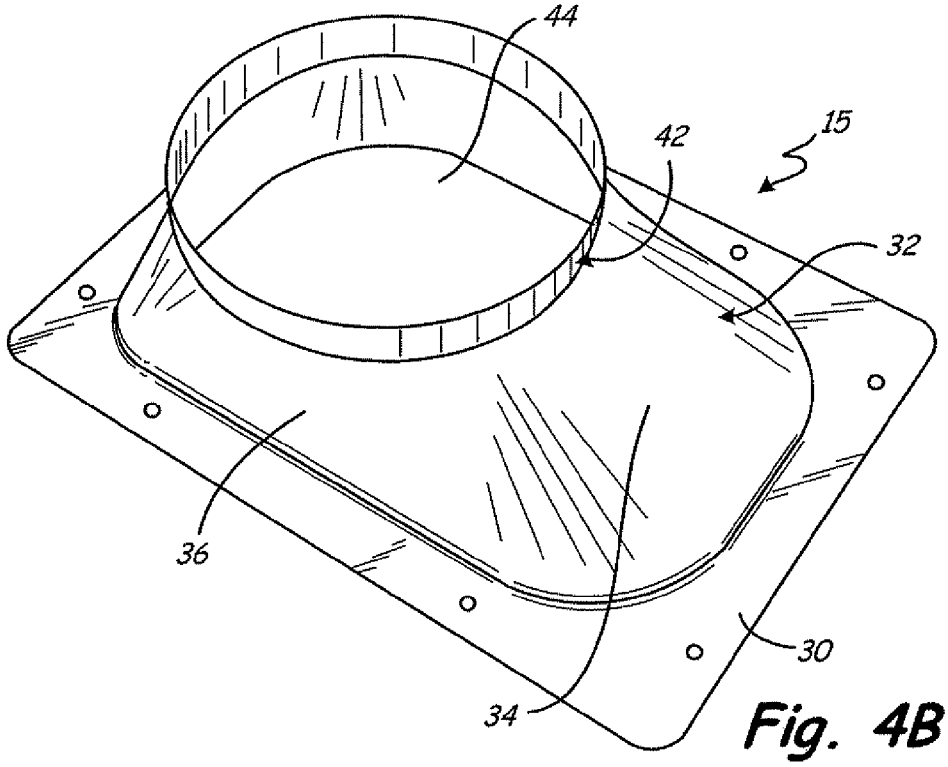
Figure 4C:
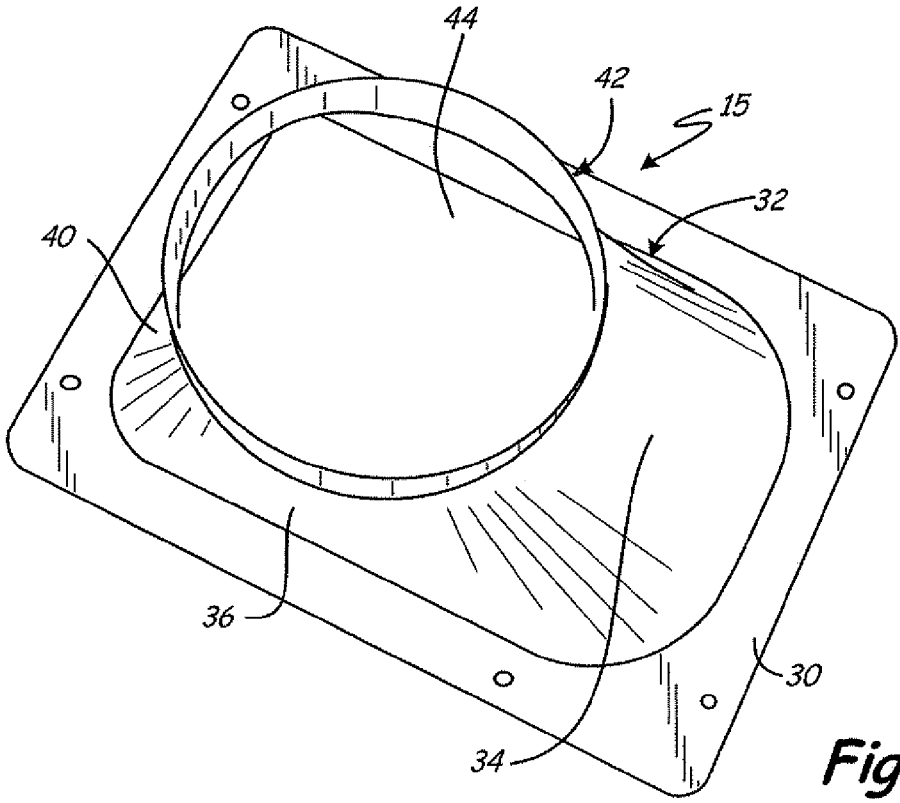
Figure 4D:
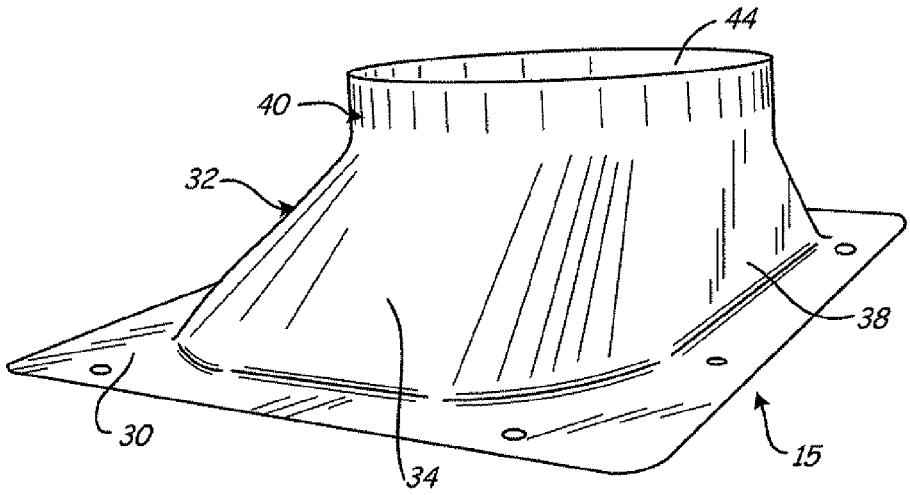
Figure 4E:
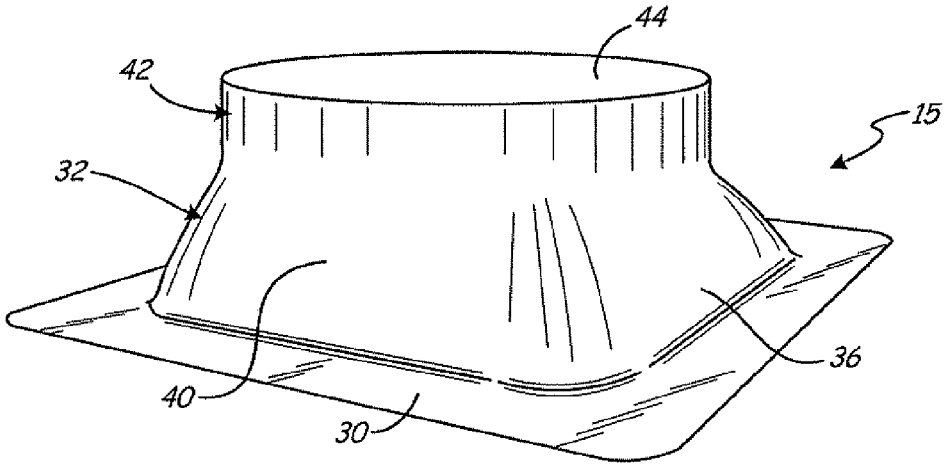
Figure 4F:
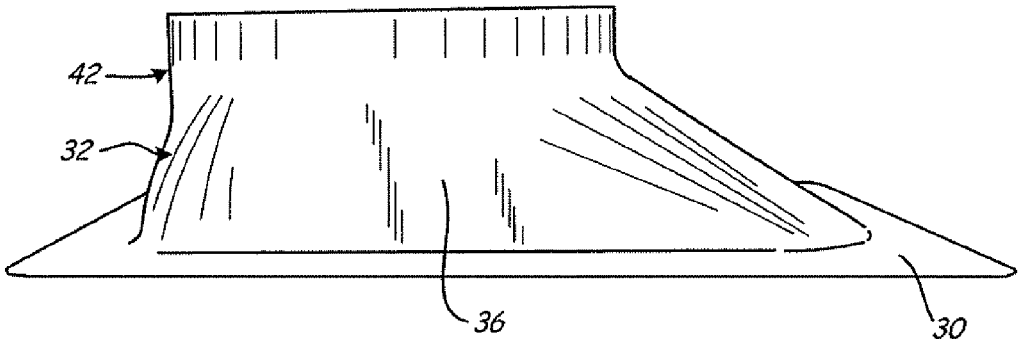
Figure 4G:
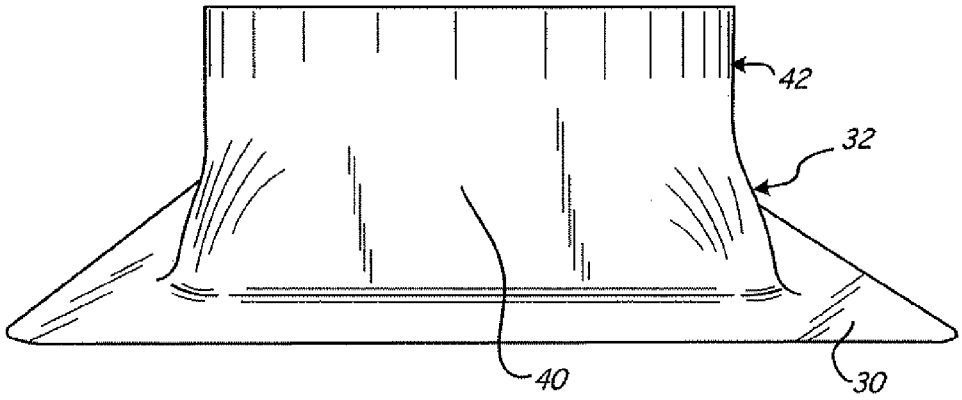
Figure 4H:
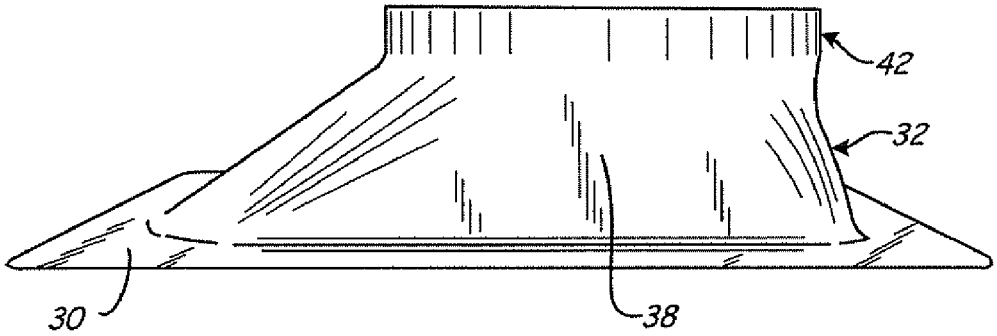
Figure 4I:
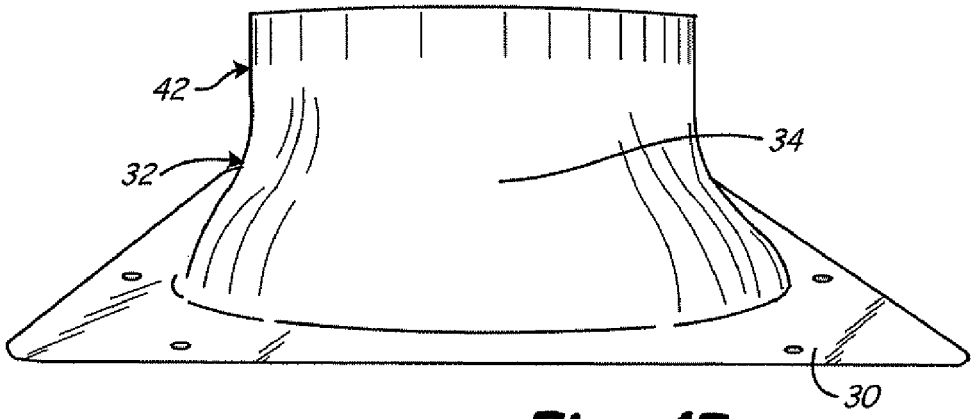
Figure 4J:
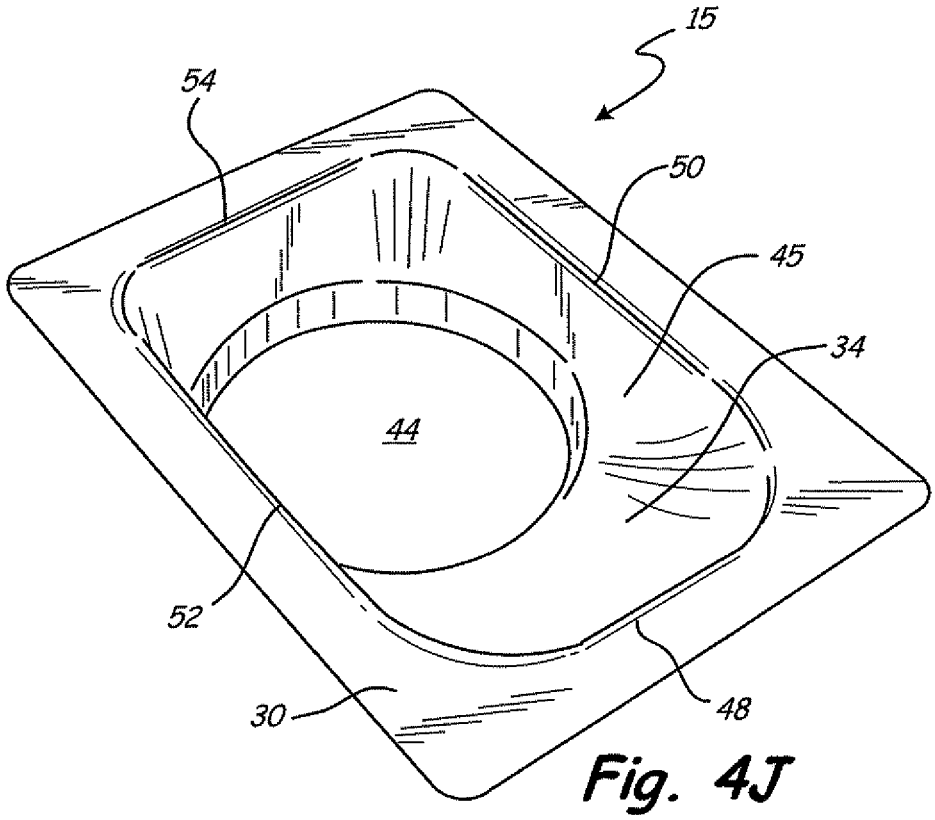

FIGS. 4F, 4G, 4H and 4I illustrate side elevational views of the HETO connector 15. FIG. 4F is a view from the side facing the side wall 36; FIG. 4G is a view from the side facing the trailing end wall 40; FIG. 4H is a view from the side facing the side wall 38; and FIG. 4I is a view from the side facing the leading end wall 34. As can be seen in these views, the transition from the flange 30 to the first body portion 32 is smooth, and the walls of the first body portion 32 are smooth and rounded, without sharp edges or interruptions. Further, the transition from the walls 34, 36, 38 and 40 to the second body portion 42 are smooth and seamless as well.

FIGS. 4J, 4K, 4L, 4M and 4N illustrate perspective views of the HETO connector 15 from a bottom side thereof. In these views, a bottom generally planar surface of the flange 30 is seen, as well as the relative shapes and configurations of an air inlet 45 and the air outlet 44 for the connector 15. The air inlet 45 is generally rectangular with curved connecting corners between its adjacent generally planar edges. Along the junction between the flange 30 and the leading end wall 34, the air inlet 45 has a generally bow-shaped leading edge 48 thereon. The curved corners between sides edges 50 and 52 of the air inlet 45 and the bow-shaped leading edge 48 are larger in radius than the curved corners between the side edges 50 and 52 and a trailing edge 54 of the air inlet 45.

Figure 4K:
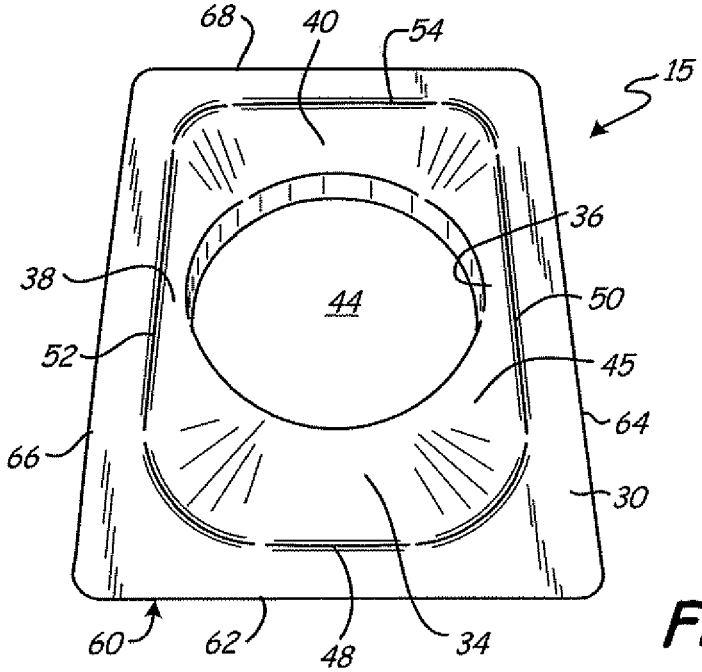
Figure 4L:
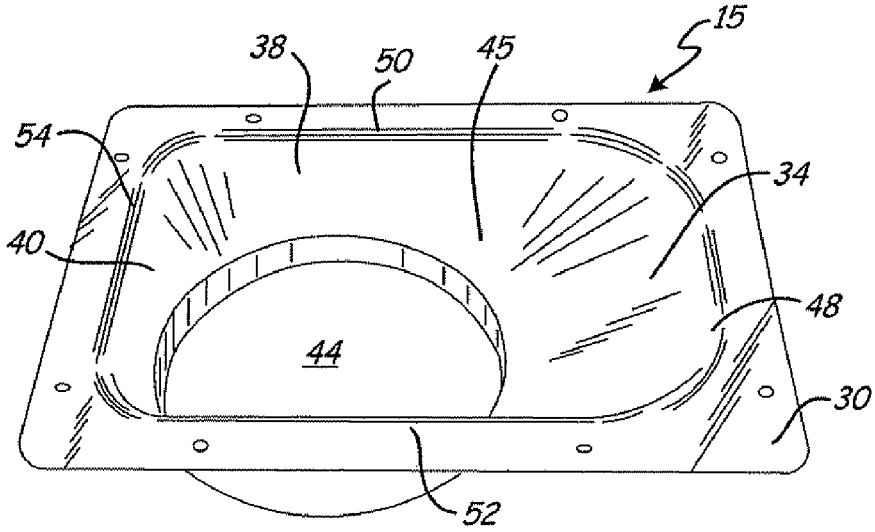
Figure 4M:
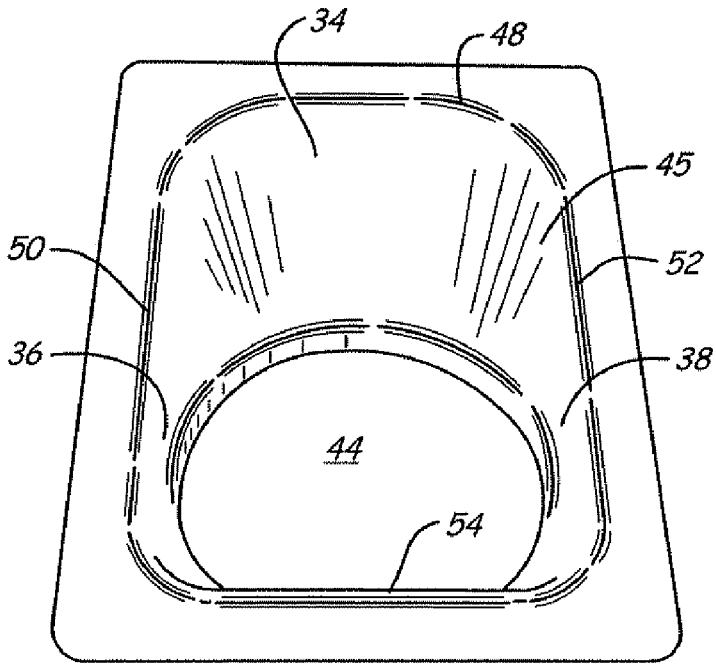
Figure 4N:
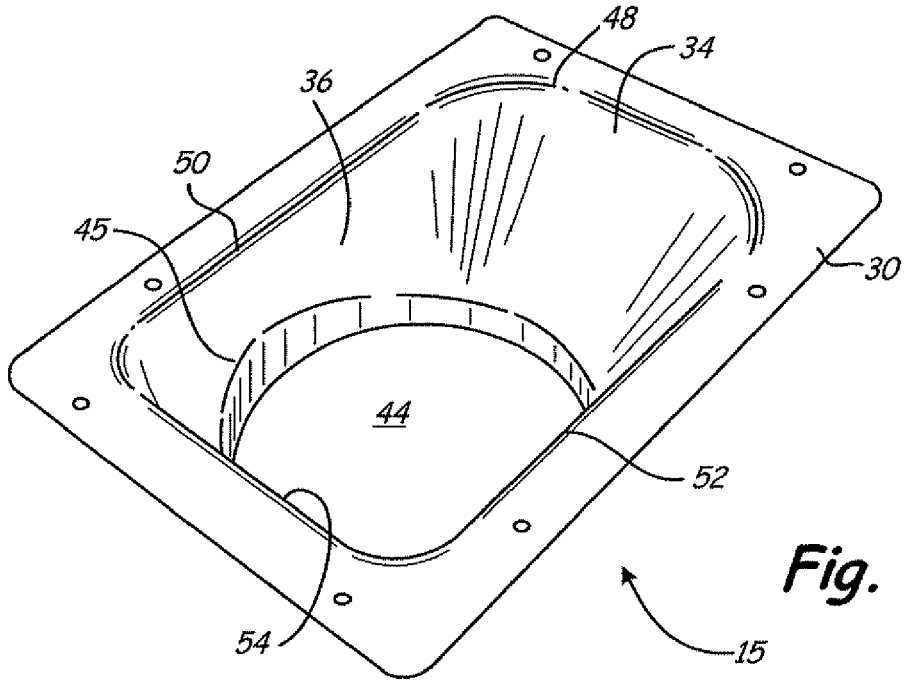
Figure 4P:
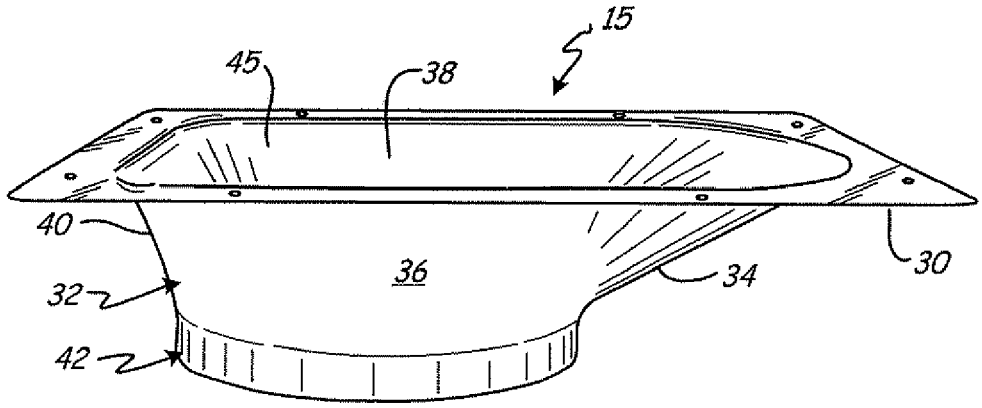
Figure 5A:
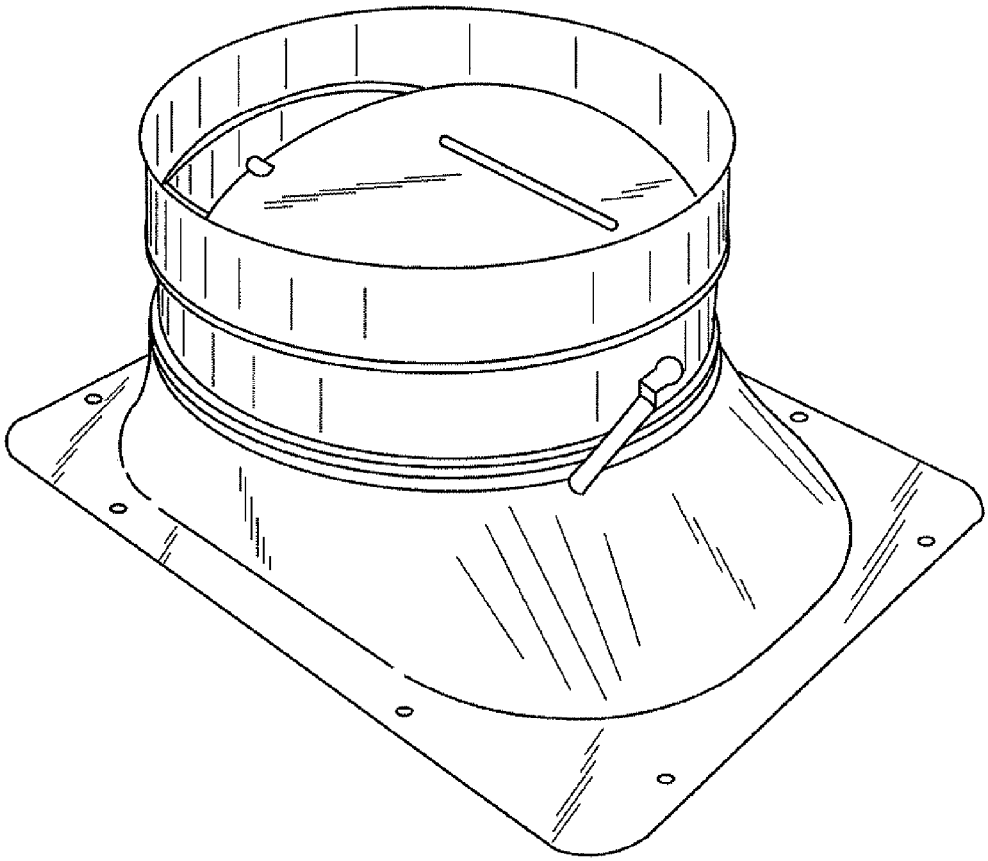
FIGS. 5A-5I are schematic views of a finished HETO connector having an adjustable damper press connected thereto.
Figure 5B:
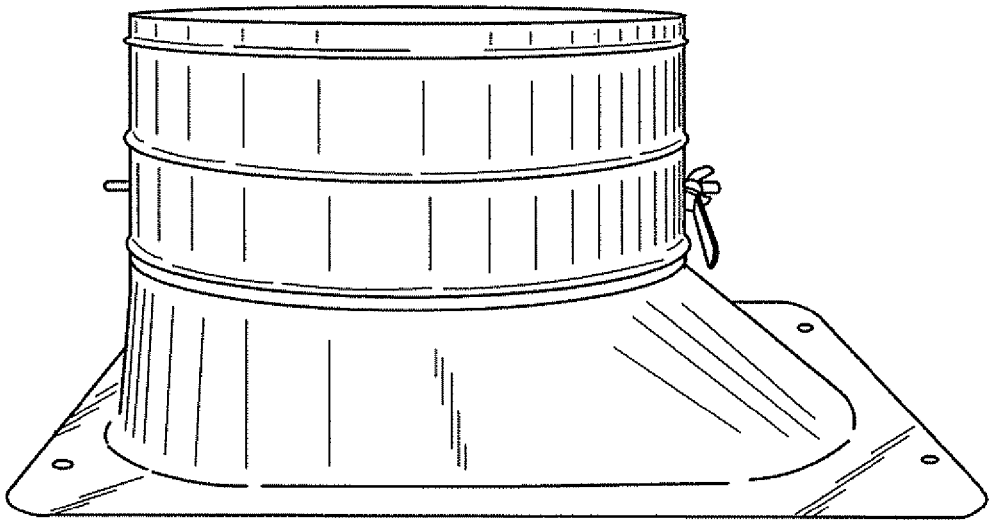
Figure 5C:
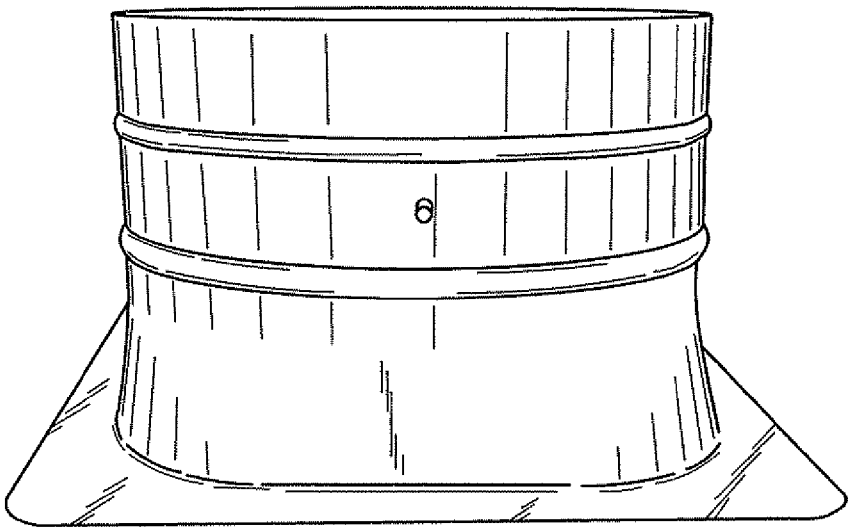
Figure 5D:
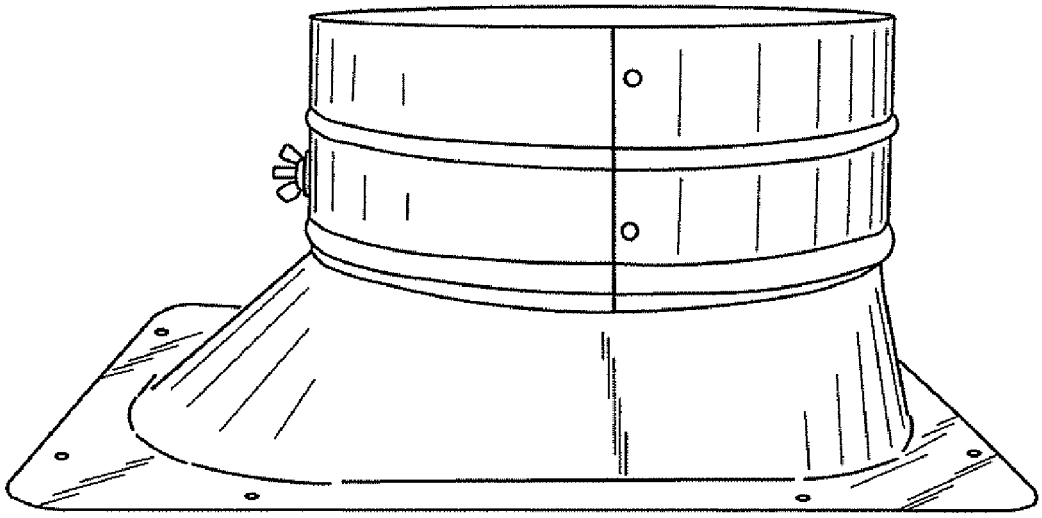
Figure 5E:
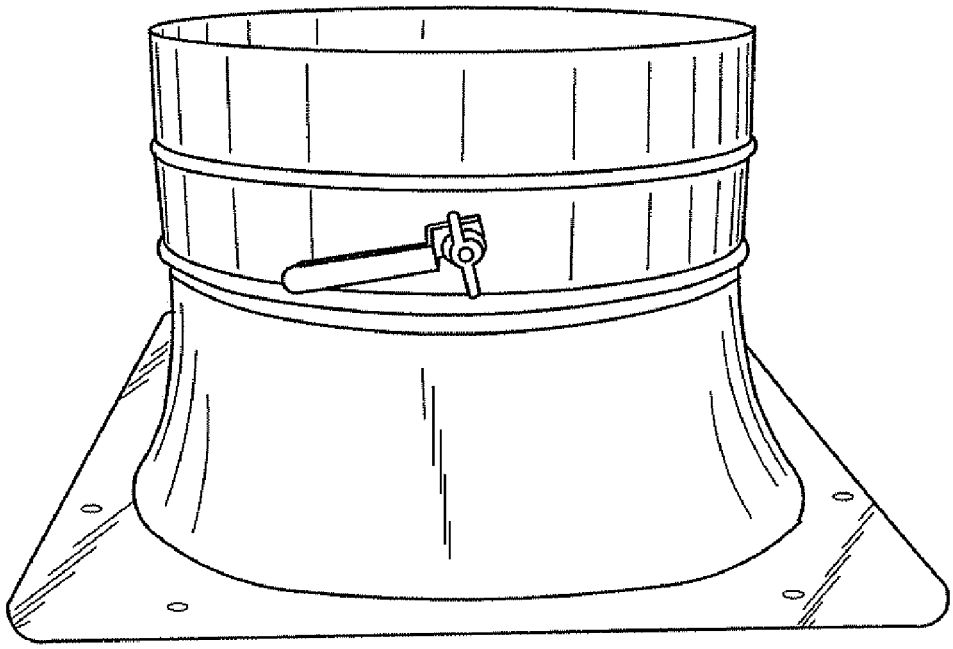
Figure 5F:
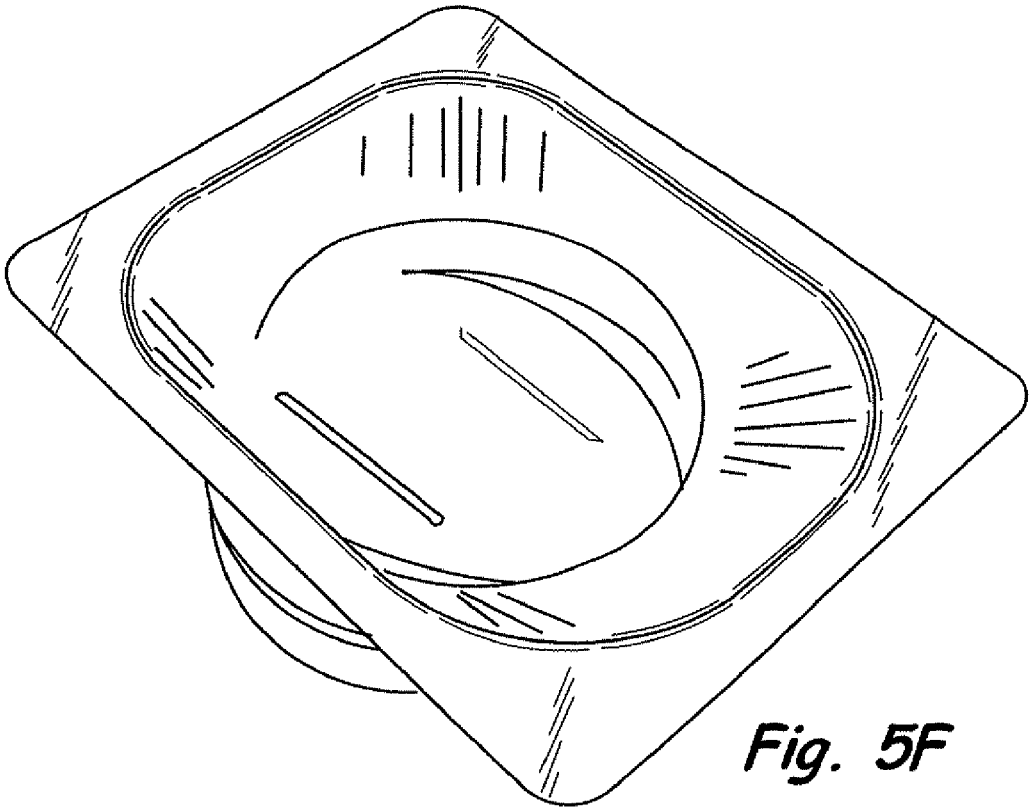
Figure 5G:
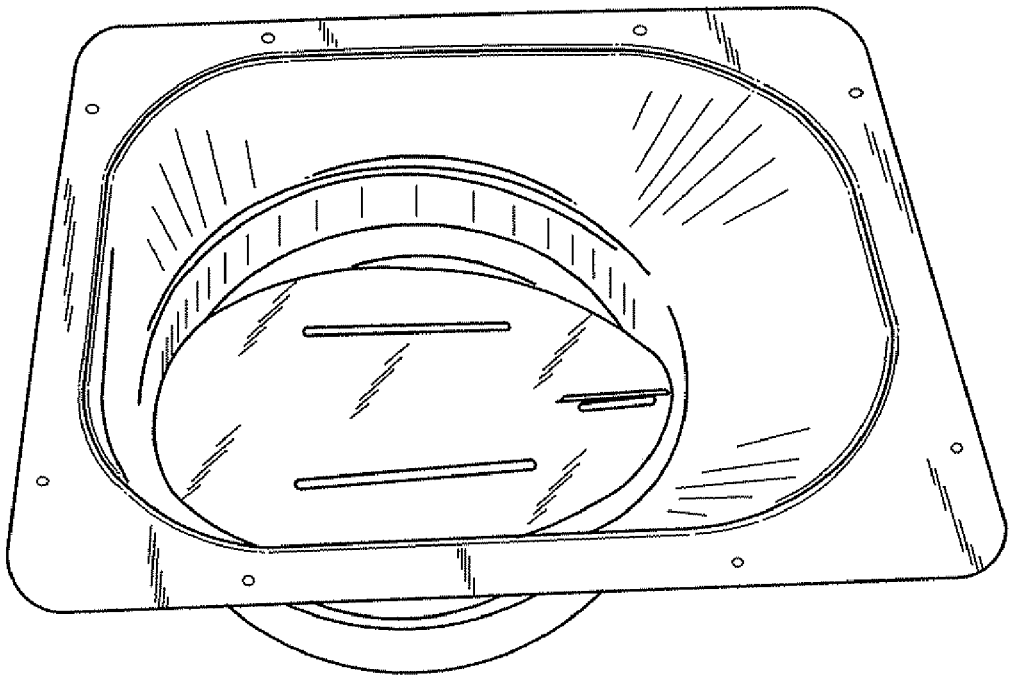
Figure 5H:
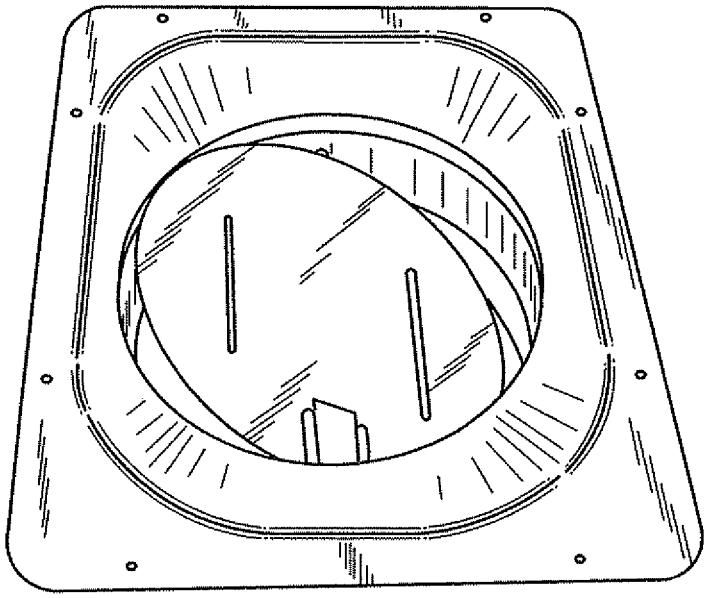
Figure 5I:
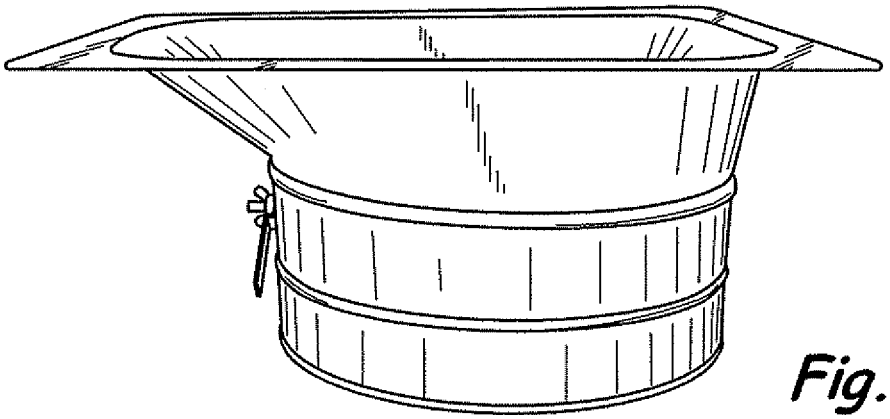

FIG. 4P is a side elevation of the HETO connector 15, as taken from the side facing the wall side wall 36 thereof. In this view, the flange 30 is illustrated at the top of the figure. As shown, the air outlet defined by the second body portion 42 is generally parallel with the flange 30.

HETO connectors are formed in a variety of sizes. The HETO connector illustrated in FIG. 5 show a connector of a different size than the one illustrated in FIG. 4. The connector illustrated in FIG. 5 also has an adjustable damper press fitted over its tubular takeoff neck thereof. The damper is a separate component which may or may not be provided on the tubular takeoff neck when installed. The HETO connector of FIG. 5 is, like the connector of FIG. 4, formed as an integral one-piece unit with first and second body portions. The second body portion again defines a tubular takeoff neck, and the first body portion has a leading end wall, two side walls and a trailing end wall. The leading end wall has a different slope relative to the mounting flange than the trailing end wall, although the slope of the connector of FIG. 5 is not the same as the slope of the connector of FIG. 4. This is because of the different size of the HETO connector of FIG. 5 relative to the connector of FIG. 4, relative to its respective inlet and outlet. In both embodiments, the slope of the leading end wall relative to the flange is shallower than the slope of the trailing end wall (and in both cases, the slope of the trailing end wall is essentially 90° relative to the mounting flange).

As noted above, the HETO connector is formed from a single sheet of sheet metal, via drawing, stamping and trimming processes. A generally planar metal sheet is first drawn to define a first body portion projecting from a generally planar mounting flange thereon. The first body portion extends from a generally rectangular air inlet having a bow-shaped leading edge and that is coplanar with the mounting flange to a circular panel that is spaced from and generally parallel to the mounting flange. The first drawing step is illustrated in FIG. 3A, where the first body portion 32*a* is shown projecting from mounting flange 30*a*. The bow-shaped leading edge 48*a* is also illustrated, along with circular panel 44*a*. The first body portion 32*a* is defined by a leading end wall 34*a*, two side walls 36*a* and 38*a* (see FIG. 3B) and a trailing end wall 40*a* (see FIG. 3D). The circular panel 44*a* is at outer ends of the walls 34*a*, 36*a*, 38*a* and 40*a* relative to the flange 30*a*. As seen in the illustration of FIG. 3, the leading end wall 34*a* has a different slope relative to the mounting flange 30*a* than the trailing end wall 40*a*.

Metal is removed from the assembly illustrated in FIG. 3 across the circular panel 44*a* to define a round air inlet that is generally perpendicular to the mounting flange 30*a* and offset toward the trailing end wall 40*a*. The outer ends of the walls 34*a*, 36*a*, 38*a* and 40*a* are then drawn further away from the mounting flange 30*a* to define a second body portion. The second body portion projects further away from the mounting flange and forms a generally tubular takeoff neck that is aligned generally perpendicular to the mounting flange 30*a*. In FIG. 3C, the dashed lines T illustrate a trimming process for removing excess metal from about the mounting flange to define a generally rectangular outer edge of the mounting flange. That rectangular outer edge is best seen in FIG. 4K, as edge 60 having leading side 62, and longitudinally extending sides 64 and 66, and trailing side 68. During trimming, dimples for fastener placement and other indicia may be stamped onto the mounting flange.

Figure 6A:
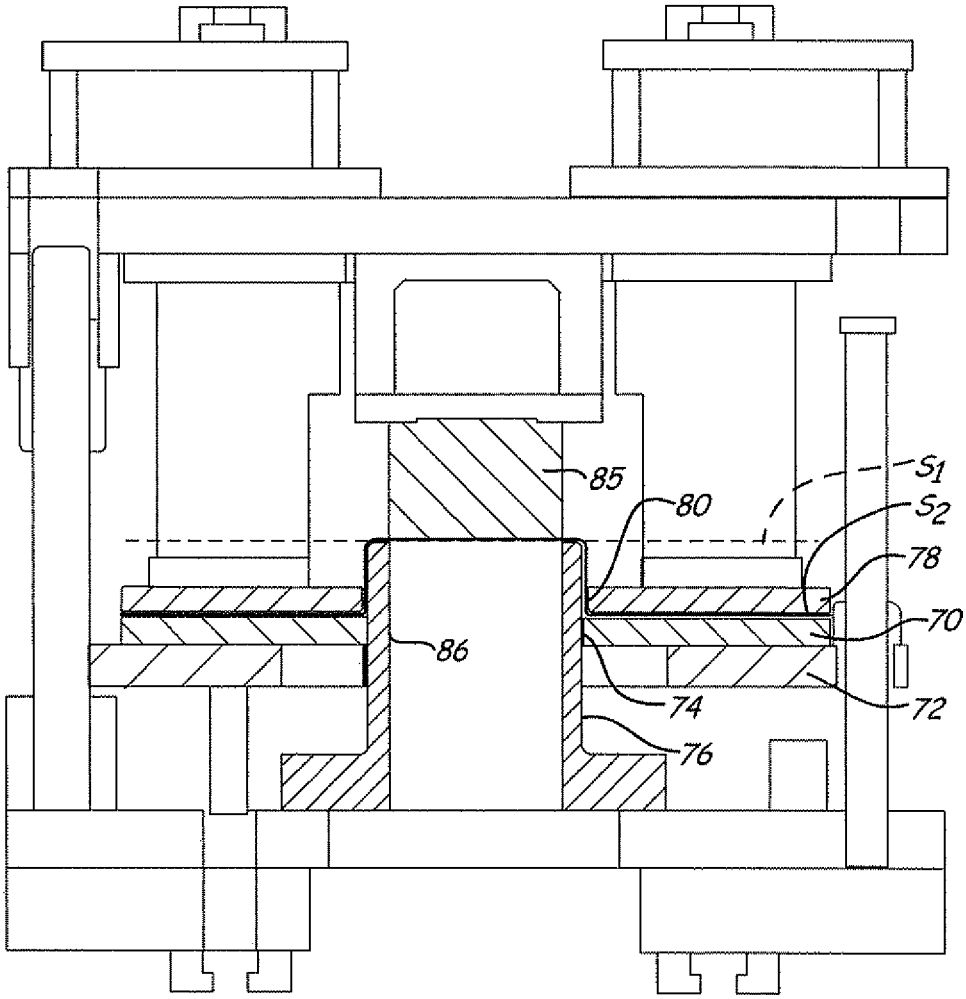
FIGS. 6A-6C are schematic views of a first die set for forming a HETO connector.
Figure 6B:
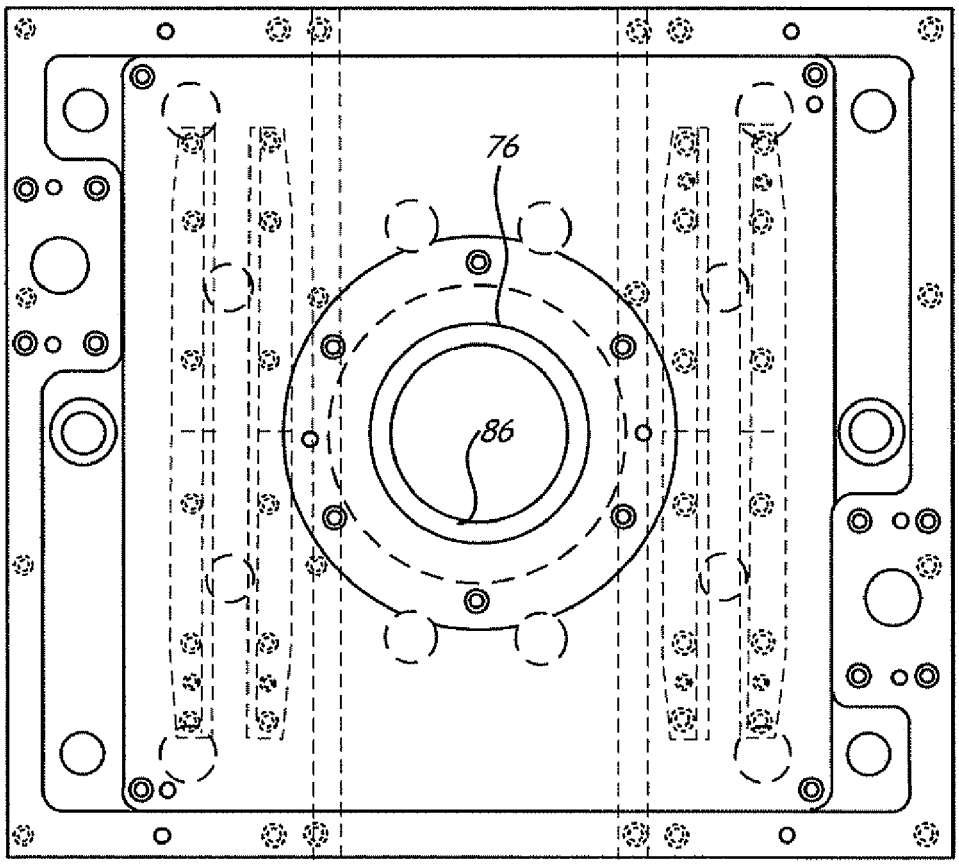

In one embodiment, the drawing, removing and trimming steps for the formation process of the HETO connector of the present invention is conducted on an AP&T Press, such as the AP&T high performance press ZM, available from AP&T North America, Inc., Monroe, N.C. A die set such as illustrated in FIG. 6 is provided in such a press to perform these forming operations. FIG. 6A shows the initial position of the single sheet of generally planar metal, in dashed lines as metal sheet $S_1$. Metal sheet $S_1$ is positioned on top of a lower platen 70, which is supported by the pressure ring 72. The lower platen 70 has a circular opening 74 defined therein for reception of a cylindrical mandrel 76 therethrough during the forming processes. An upper circumfential edge of the mandrel 76 is curved to facilitate the drawing of metal thereover. Once the metal sheet $S_1$ is positioned on the platen 70, the press is activated and a draw ring 78 lowers onto the metal sheet $S_1$ thereby affixing it between opposed planar faces of the draw ring 78 and platen 70. The draw ring 78 has an opening 80 therein, aligned over the opening 74 in the platen 70. The opening 80 in the draw ring is shaped to define the air inlet for the HETO connector, and as seen in FIG. 6B, has a generally rectangular configuration with a bow-shaped leading edge thereof. Edges of the opening 80 are curved to facilitate metal drawing there through.

The assembly of the platen 70, metal sheet $S_1$ and draw ring 78 are urged downwardly together relative to the mandrel 76. The opening in the draw ring 78 is offset relative to the opening 74 in the platen 70 and the cylindrical mandrel 76 so that the mandrel 76 is adjacent to what will become a trailing wall of the first body portion of the HETO connector being formed. As the assembly of platen 70, metal sheet $S_1$ and draw ring 78 are edged downwardly over the mandrel 76, the mandrel 76 draws metal into the form illustrated in FIG. 3. The metal sheet $S_2$ illustrated in solid lines between the platen 70 and the draw rings 78 in FIG. 6A thus has its first body portion formed as illustrated in FIG. 3. The circular panel (panel 44*a* in FIG. 3) is disposed along the top of mandrel 76. The die has a circular punch 85 which is driven downwardly into a cylindrical bore 86 within the mandrel 76 to remove a circular piece of metal from the metal sheet $S_2$. The circular piece falls through the cylindrical bore 86 as excess material.

The assembly of the platen 70, metal sheet $S_2$ (now with a first body shape projecting therefrom and circular hole punched therein) and draw ring 78 are then further urged downwardly relative to the mandrel 76 to draw the remaining metal about the circular hole over the mandrel 76, and thereby define the second body portion of the HETO connector (which is in the form of a tubular takeoff neck). The tubular neck is aligned generally perpendicular to the portion of the sheet metal $S_2$ that was retained between the platen 70 and the draw ring 78. The assembly is then withdrawn upwardly relative to the mandrel 76, and the draw ring 78 is further withdrawn upwardly relative to the platen 70, so that the subassembly (the in-process unit) may be removed from the die set. Because the metal sheet being drawn is being drawn in an asymmetrical manner (it has longer side walls than end walls, and secondly, the trailing and leading end walls are being drawn to have different slopes and the tubular takeoff neck is offset relative to the air inlet portion), portions of the metal sheet are drawn to a greater degree than other portions.

Figure 6C:
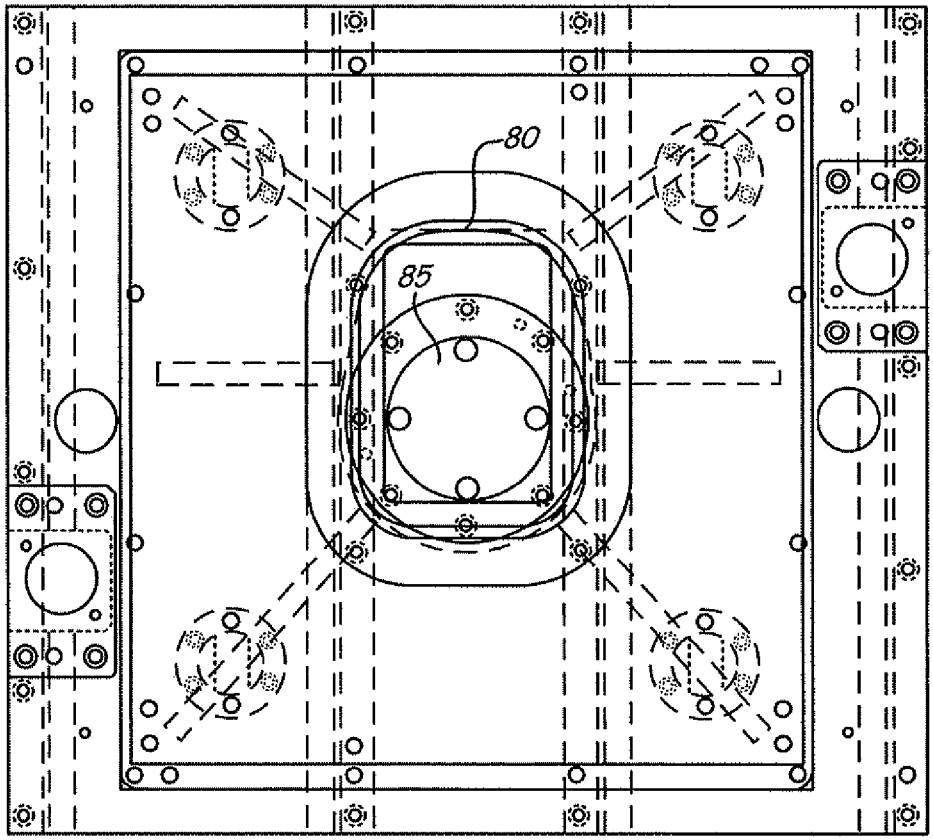

FIG. 6A is a side schematic view, with some parts shown in section, of a die set for forming an initial subassembly of the HETO connector of the present invention. FIG. 6B is a top view of the mandrel 76 mounted on a base of the die set of FIG. 6A. FIG. 6C is a view from below of the draw ring 78 and generally rectangular opening 80 therein, with the circular punch 85 seen through the opening 80.

The subassembly is then positioned in a second die set for trimming excess mounting flange material and to provide other features on the mounting flange (such as dimples for connectors and/or indicia thereon). A second die set for this purpose is illustrated in FIG. 7. A formed metal sheet $S_3$ is placed on top of a platen 90 which has an insert 92 projecting upwardly therefrom in the shape of the air inlet that is formed on the metal sheet $S_3$. The platen 90 and insert 92 are illustrated in FIG. 7B. The draw ring 94 is moved downwardly toward the metal sheet $S_3$. A draw ring 94 has an opening 95 therein to accommodate the portions of the metal sheet $S_3$ projecting upwardly from its flange. A cutting ring 96 is affixed to the draw ring 94 to trim the flange outer edge between the post faces 97 and 98. One or more punches or pins 99 are provided to create dimples or holes in the flange for sheet metal connectors. In addition, other impression forming stamps are provided on the draw ring 94 to stamp indicia in the flange.

Figure 7A:
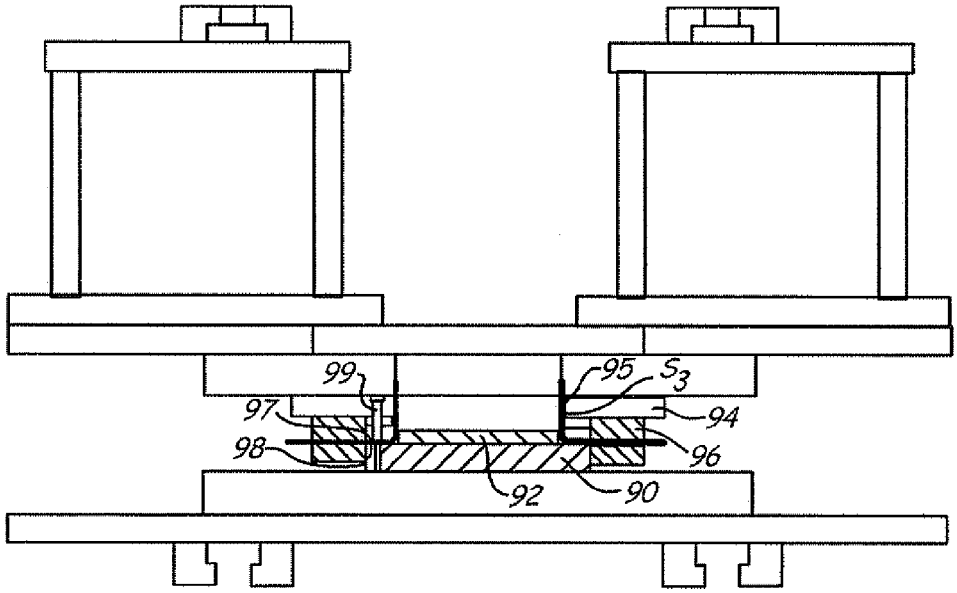
FIGS. 7A-7B are schematic views of a second die set for forming a HETO connector.
Figure 7B:
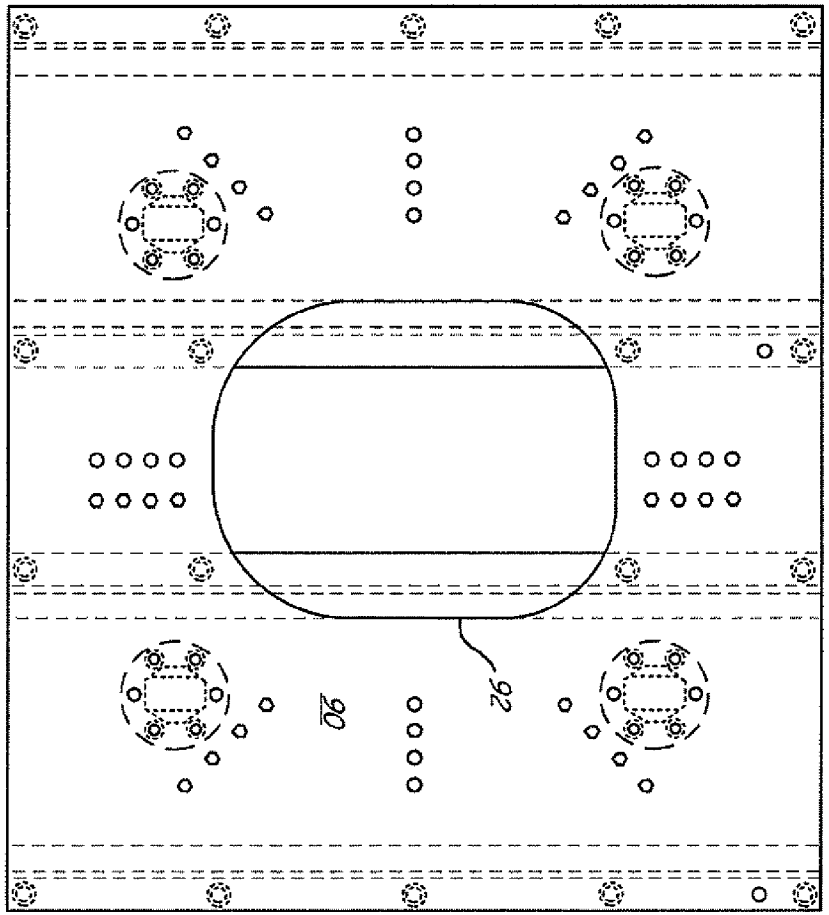

FIG. 7A is a side schematic view of a die set for use in the final trimming and stamping steps of the HETO connector formation, with some parts shown in section. FIG. 7B is a top view of the platen 90 of the die set of FIG. 7A.

Although the concepts presented herein have been described with reference to particular embodiments, workers skilled in the art will recognize that changes may be made in form and detail without departing from the spirit and scope of the claims that follow.

The invention claimed is:

1. A method of making an HVAC high efficiency takeoff connector from a single sheet of generally planar metal, the method comprising:

drawing the metal sheet to define a generally rectangular air inlet, a circular panel, and a first body portion projecting from a generally planar mounting flange, wherein the first body portion extends from the generally rectangular air inlet having a generally bow-shaped leading edge and that is coplanar with the mounting flange to the circular panel that is spaced from and generally parallel to the mounting flange, wherein the first body portion is defined by a leading end wall, two side walls and a trailing end wall with the circular panel at outer ends of the walls, and wherein the leading end wall has a different slope relative to the mounting flange than the trailing end wall;

removing metal extending across the circular panel to define a round air outlet that is generally perpendicular to the mounting flange and offset toward the trailing end wall;

drawing the outer ends of the walls of the first body portion to define a second body portion projecting further away from the mounting flange, wherein the second body portion forms a generally tubular takeoff neck that is aligned generally perpendicular to the mounting flange; and trimming excess metal from about the mounting flange to define a generally rectangular outer edge of the mounting flange.

2. The method of claim 1 wherein the two side walls have a similar slope relative to the mounting flange as the trailing end wall.

3. The method of claim 1 wherein the first body portion is a seamless construction.

4. The method of claim 1 wherein the second body portion is a seamless construction.

5. The method of claim 1 wherein the first body portion, the second body portion and the mounting flange together form a seamless construction.

6. The method of claim 1 wherein a distance along the leading end wall from the mounting flange to the second body portion is at least two times greater than a distance along the trailing end wall from the mounting flange to the second body portion.

7. The method of claim 1 and further comprising:

forming dimples in the mounting flange to indicate locations for mounting fasteners used to fasten the mounting flange to ductwork.

8. The method of claim 1 and further comprising:

using a first die set in a press to form the first body portion and the second body portion; and using a second die set in the press to trim the mounting flange.

* * * * *